United States Patent [19]

Yoshihara

[11] Patent Number: 4,732,304

[45] Date of Patent: Mar. 22, 1988

[54] ROTARY NOZZLE SYSTEM

[75] Inventor: Tetsuya Yoshihara, Yokohama, Japan

[73] Assignees: Nippon Kokan Kabushiki Kaisha, Tokyo; Nippon Rotary Nozzle Co., Ltd.; Kokan Kikai Kogyo Kabushiki Kaisha, both of Kawasaki; Tokyo Yogyo Kabushiki Kaisha, Tokyo, all of Japan

[21] Appl. No.: 927,451

[22] Filed: Nov. 6, 1986

[30] Foreign Application Priority Data

Nov. 18, 1985 [JP] Japan ..... 60-256703
Dec. 27, 1985 [JP] Japan ..... 60-293234

[51] Int. Cl.[4] ..... B22D 41/08

[52] U.S. Cl. ..... 222/598; 222/512; 266/236

[58] Field of Search ..... 222/598, 599, 591, 512; 266/236; 251/174, 180, 192

[56] References Cited

U.S. PATENT DOCUMENTS 4,314,659 2/1982 Shapland ..... 222/598 X
4,385,715 5/1983 Meier et al. ..... 222/598
4,591,080 5/1986 Yoshihara ..... 222/598

FOREIGN PATENT DOCUMENTS 0128841 12/1984 European Pat. Off. .
2551374 3/1985 France .
2023784 1/1980 United Kingdom .
2146100 4/1985 United Kingdom .
755429 8/1980 U.S.S.R. ..... 222/598

*Primary Examiner*—Joseph J. Rolla
*Assistant Examiner*—Nils E. Pedersen
*Attorney, Agent, or Firm*—Fleit, Jacobson, Cohn & Price

[57] ABSTRACT

A rotary nozzle system attached to the outlet of a metallurgical vessel to serve as a gate valve for controlling the rate of pouring of molten metal. A slide plate brick and bottom plate brick, each having a nozzle bore, are relatively rotated in a surface-to-surface contact condition to adjust the degree of communication opening of the nozzle bores. Each of the plate bricks is formed on the outer peripheral surface thereof with a flat portion for receiving the driving force for the relative reaction force at each of four locations arranged at angular intervals of 90°.

9 Claims, 18 Drawing Figures

ROTARY NOZZLE SYSTEM

BACKGROUND OF THE INVENTION

1. Field of the Invention

The present invention relates to a rotary nozzle system which is attached to the bottom outlet of a metallurgical vessel, such as, a ladle or tundish, whereby its slide plate brick is rotated so as to adjust the opening and closing or the degree of opening of a nozzle bore formed in a fixed bottom plate brick and thereby to control the rate of pouring of molten steel or the like.

2. Description of the Prior Art

Rotary nozzle systems have been used widely with ladles for receiving the molten steel tapped from a converter to transport or pour the molten steel into molds, tundishes for receiving the molten steel from a ladle to pour the molten steel into molds and the like.

A good example of this type of rotary nozzle system is shown in U.S. Pat. No. 4,591,080.

The conventional rotary nozzle system is disadvantageous in that there is the danger of the slag or the like entering between the sliding surfaces of the slide plate brick and the fixed bottom plate brick and causing leakage of the molten steel. The entry of the slag or the like between the sliding surfaces is promoted by the occurrence of cracks extending radially from the nozzle bores in the fixed and slide plate bricks and therefore it is necessary to bind each of the plate bricks all around its periphery from outside with a steel band or the like. Also, during the closing of the nozzle bores, if the interfacial pressure between the brick sliding surfaces which varies in inverse proportion to the magnitude of the area of contact between the plate bricks is allowed to rise slowly, the force of the molten steel flowing through the throttled flow passage acts in directions tending to separate the sliding surfaces from each other and thus the molten steel tends to enter between the sliding surfaces. Moreover, there are cases where the fixed bottom plate brick shifts during the rotation of the slide plate brick and such movement causes an excessive sliding movement, thereby promoting the entry of the molten steel between the sliding surfaces.

SUMMARY OF THE INVENTION

It is the primary object of the present invention to provide a rotary nozzle system so designed that during the relative rotation of a slide plate brick and a fixed bottom plate brick the molten metal or slag is prevented from easily entering between the sliding surfaces of the plate bricks from around the nozzle bores and hence the occurrence of any trouble of run-out from between the sliding surfaces is not easy.

It is another object of the invention to provide such rotary nozzle system so designed that a binding force is caused to act on the outer periphery of each of the two plate bricks from all sides without using a steel band or the like thereby preventing the occurrence of radial cracks or the from the nozzle bore in the plate brick, and also the fixed bottom plate brick is prevented from making any undesired shift when a turning force is transmitted to the slide plate brick.

It is still another object of the invention to provide such rotary nozzle system so designed that the interfacial pressure between the sliding surfaces of the plate bricks is caused to rise more rapidly during the starting period of the closing of the nozzle bore.

To accomplish the above objects, in accordance with one aspect of the rotary nozzle system according to the invention each of the plate bricks is formed on its outer peripheral surface with four flat portions arranged at angular intervals of 90° so as to receive the driving force for the relative rotation and/or the reaction force.

In accordance with a preferred embodiment of the invention, each of the plate bricks has a regular octagonal outer shape (contour).

In accordance with another aspect of the invention, the outer periphery of each plate brick is enclosed by a support frame formed with four flat inner peripheral wall surfaces at angular interval of 90° to correspond to the flat portions on the outer periphery of the plate brick and unopposing two of the flat inner peripheral wall surfaces are each adjustable in position so as to be close to or away from the counter flat portion.

In accordance with a preferred embodiment of the invention, with a view to rapidly increasing the interfacial pressure between the sliding surface of the plate bricks in response to the relative rotation during the starting period of the closing of the nozzle bore, the slide plate brick and the fixed bottom plate brick have regular octagonal outer shapes of the same size with each other and their regular octagonal outer shapes are exactly registered without any shift when the nozzle bores of the plate bricks are brought into alignment.

In accordance with another embodiment of the invention, in order that the extraneous matter entering between the sliding surfaces of the plate bricks may be discharged to the outside in response to the relative rotation, the sliding surface of the fixed bottom plate brick is formed with a groove extending from the inside to the outer periphery. This groove is formed at a position such that the groove is not communicated simultaneously with both of the nozzle bores within the range of relative rotational angles of the plate bricks. In accordance with a specific example, the groove extends radially on the opposite side of the nozzle bore with respect to the center of the relative rotation of the plate bricks.

DESCRIPTION OF THE PREFERRED EMBODIMENTS

Before describing preferred embodiments of the invention, a conventional rotary nozzle system will be described with reference to FIGS. 1 to 6 to facilitate the understanding of the invention.

Figure 1:
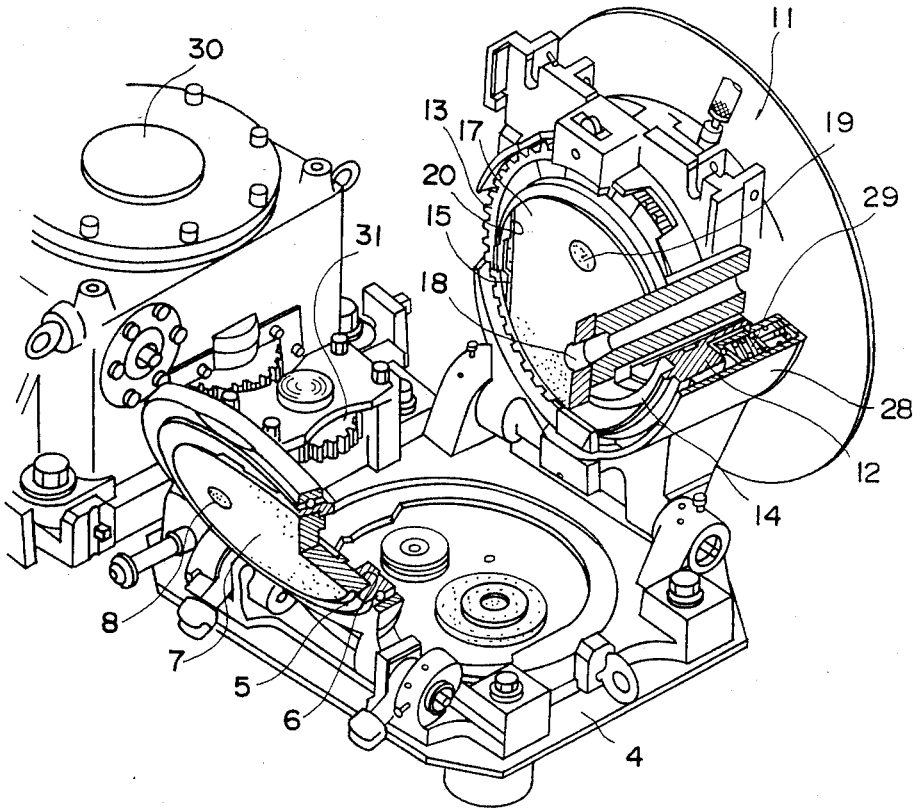
FIG. 1 PRIOR ART
FIG. 1 is a partially cutaway perspective view showing the construction of a conventional rotary nozzle system.
Figure 2:
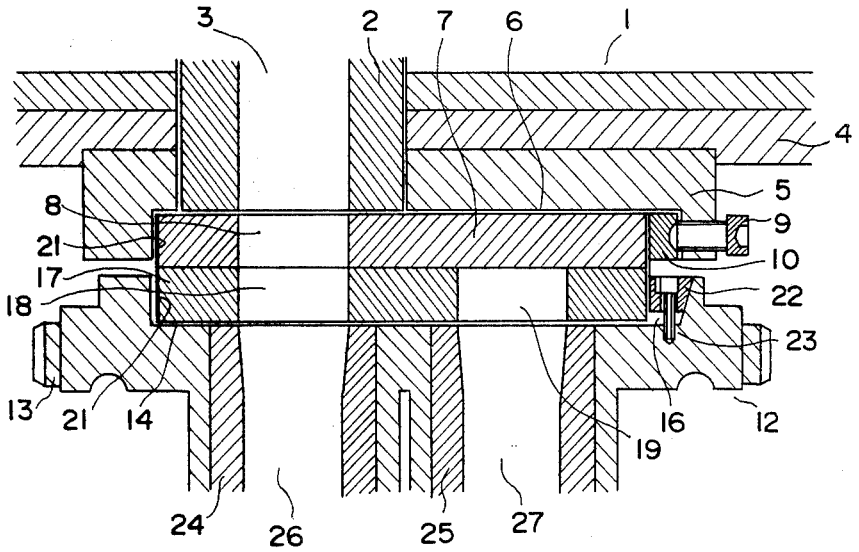
FIG. 2 PRIOR ART
FIG. 2 is a schematic side view showing the conditions of the principal parts of the conventional rotary nozzle system in use.

FIG. 1 is a perspective view of a rotary nozzle system of the type used conventionally and FIG. 2 is a schematic diagram showing the principal parts of the rotary nozzle system in section. In the Figures, numeral 4 designates a base member attached to the bottom shell of a vessel 1 comprising a ladle or the like, and 5 a support frame pivotably attached to the base member 4 with a hinge and formed with a recess 6 in which fixedly mounted is a fixed bottom plate brick 7 made of a refractory material and including a nozzle bore 8. Numeral 2 designates a top nozzle fitted in the bottom shell of the ladle 1 and its nozzle bore 3 is aligned with the nozzle bore 8 of the bottom plate brick 7.

Numeral 12 designates a rotor provided with a spur gear 13 which is an integral part of the outer surface thereof. The rotor 12 is formed with a recess 14 in which fixedly mounted is a slide plate brick 17 made of a refractory material and including nozzle bores 18 and 19 the rotor 12 is received in a case 28 which is pivotably attached to the base member 4 through a hinge. When the support 5 and the case 28 are closed, the slide plate brick 17 is pressed against the bottom plate brick 7 by a plurality of springs 29 mounted in the case 28. Numerals 24 and 25 designate collector nozzles respectively having nozzle bores 26 and 27 which are respectively aligned with the nozzle bores 18 and 19 of the slide plate brick 17.

Figure 3:
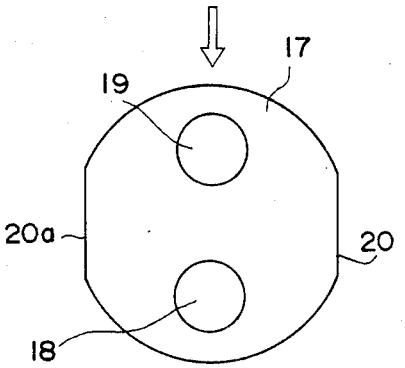
FIG. 3 PRIOR ART
FIG. 3 is a plan view of the slide plate brick used in the conventional rotary nozzle system.
Figure 4:
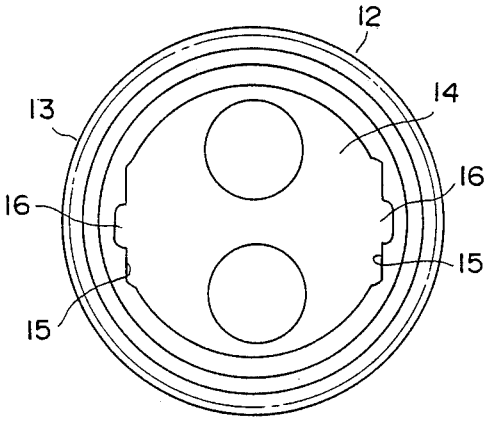
FIG. 4 PRIOR ART
FIG. 4 is a plan view of the rotor in the conventional rotary nozzle system.

As shown in FIG. 3, the slide plate brick 17 is formed into an oval shape with the sides forming flat portions 20 and 20*a*. Also, as shown in FIG. 4, the recess 14 of the rotor 12 is formed into a shape which is similar to but slightly greater than the slide plate brick 17 and its sides are formed with locking portions 15 corresponding to the flat portions 20 and 20*a* of the slide plate brick 17 and each of the locking portions 15 is formed with a cutout 16. The slide plate brick 17 is received and fixedly mounted in the recess 14 of the rotor 12 by fastening a wedge 22 fitted in each of the cutouts 16 of the rotor 12 with a bolt 23 as shown in FIG. 2.

The bottom plate brick 7 has substantially the same shape as the slide plate brick 17 and it is received and fixedly mounted in the recess 6 of the support frame 5 by fastening a screw 9 through a locking piece 10 as shown in FIG. 2.

As will be seen from FIG. 1, the rotary nozzle system constructed as described above is so designed that after the support frame 5 and the case 28 have been closed, the rotor 12 is rotated by an electric motor 30 through an intermediate gear 31 and the spur gear that the slide plate brick 17 mounted on the rotor 12 is rotated and the relative positions of the nozzle bore 8 of the bottom plate brick 7 and the nozzle bore 18 (or 19) of the slide plate brick 17 are adjusted, thereby adjusting the nozzle opening as desired.

While the rotary nozzle system of the above type is now in wide use owing to its various advantages over the formerly used reciprocating-type slide nozzle system, the bottom plate brick and the slide plate brick forming the essential parts of the system involve the following problems. (1) There is the danger of the slag or the like entering between the sliding surface of the plate bricks 7 and 17 so that the degree of the close contact between the plate bricks 7 and 17 is decreased and a gap is produced, thereby causing the molten steel to leak from the gap. (2) Since the bottom plate brick 7 and the slide plate brick 17 are respectively mounted on the support frame 5 and the rotor 12 by pressing one side wall of each of the plate bricks 7 and 17 with the screw 9 or the wedge 22, each of the plate bricks 7 and 17 is contacted with the support frame 5 or the rotor 12 with only one of the flat portions or cutouts (e.g., the flat portion 20*a* in FIG. 3). As a result, the pressing force is concentrated at the sides of the flat portion 20*a* and no binding force is provided for the cracks caused radially from the nozzle bores 8, 18 and 19 of the plate bricks 7 and 17. To prevent this, a steel band 21 (FIG. 2) must be fastened on the outer periphery of the plate bricks 7 and 17, respectively, and this operation is very difficult.

Figure 5:
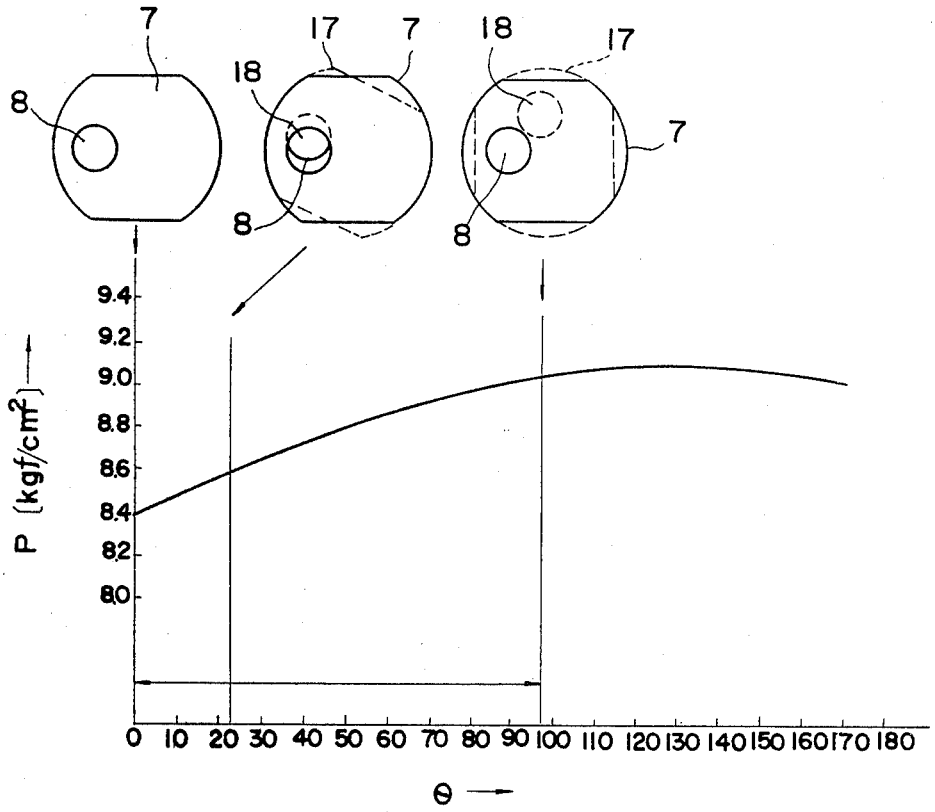
FIG.5 PRIOR ART
FIG. 5 is a graph showing the relation between the relative rotational angle $\theta$ (abscissa) and the interfacial pressure P (ordinate) between the sliding surfaces in the conventional rotary nozzle system.

The interfacial pressure P ($Kg/cm^2$) between the bottom plate brick 7 and the slide plate brick 17 is as follows $$P=K/S$$

Where K is the pressing force of the springs 29 and S is the contact area of the plate bricks 7 and 17. Thus, the interfacial pressure P is increased with a decrease in the contact area of the plate bricks 7 and 17. FIG. 5 shows by way of example the relation between the rotational angle $\theta$ of the side plate brick 17 and the interfacial pressure P. In other words, the interfacial pressure P is as low as about 8.4 $Kg/cm^2$ at the position of 0° where the nozzle bores 8 and 18 are fully opened and the contact area of the plate bricks is decreased as the slide plate brick 17 is rotated. Thus, the interfacial pressure P is increased gradually (e.g., 8.6 $Kg/cm^2$ when the rotational angle $\theta$ is 22.5°) and the interfacial pressure P is increased to about 9 $Kg/cm^2$ at the position where the rotational angle $\theta$ attains 97°. Thus fully closing the nozzle bores 8 and 18. Then, when the slide plate brick 17 is rotated further, the interfacial pressure P is increased slightly but it remains substantially on the same level. The interfacial pressure P is decreased when the opening of the nozzle bores 8 and 18 is started again.

Figure 6:
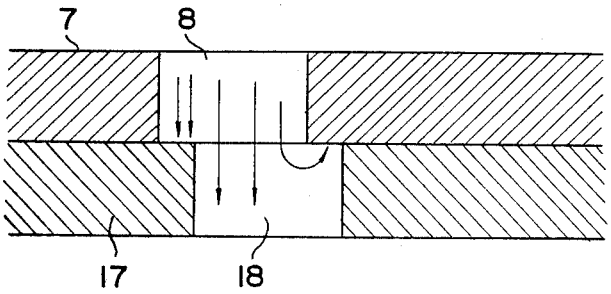
FIG.6 PRIOR ART
FIG. 6 is a partial sectional view for explaining the manner in which the molten metal flows during the starting period of the closing of the nozzle bore.

In operation, when the slide plate brick 17 is rotated from the fully-open position in the closing direction, as shown in FIG. 6, the falling molten steel strikes against and imports a heavy impact force to the edge uper surface of the nozzle bore 8 of the slide plate brick 17 and the molten steel is introduced onto the edge lower surface of the bottom plate brick 7. Thus, not only the edges of the nozzle bores 8 and 18 of the plate bricks 7 and 17 suffer melting loss, but also the pressing force due to the impact produces a gap between the sliding surfaces of the plate bricks 7 and 17 thus causing the danger of the molten metal leaking from the gap.

Therefore, while it is desirable that the interfacial pressure P is increased rapidly during the initial closing period of the nozzle bores, in the past the rise of the interfacial pressure P at this stage is gentle as shown in FIG. 5 thus tending to cause such problems as mentioned previously.

Figure 7A:
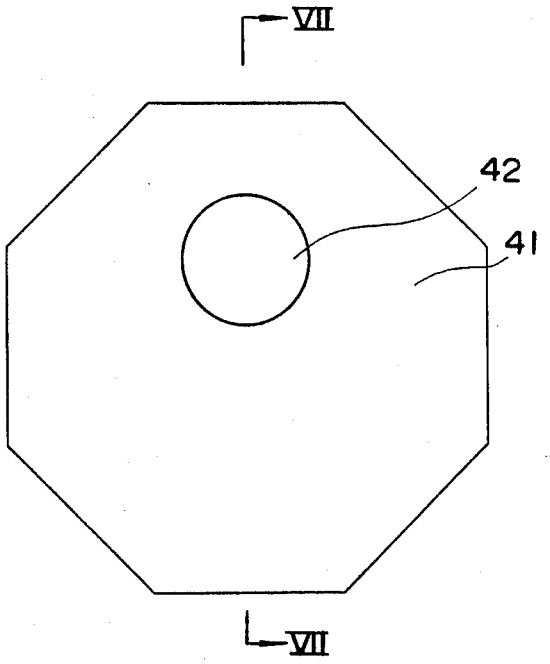
FIG. 7*a* and 7*b* are respectively a plan view showing an example of the fixed bottom plate brick used in a rotary nozzle system according to the invention and a sectional view taken along the line VII—VII of FIG. 7*a*.
Figure 7B:
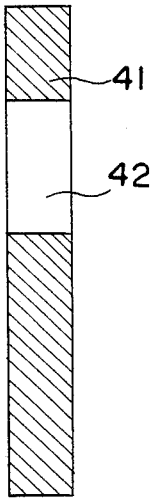
Figure 8A:
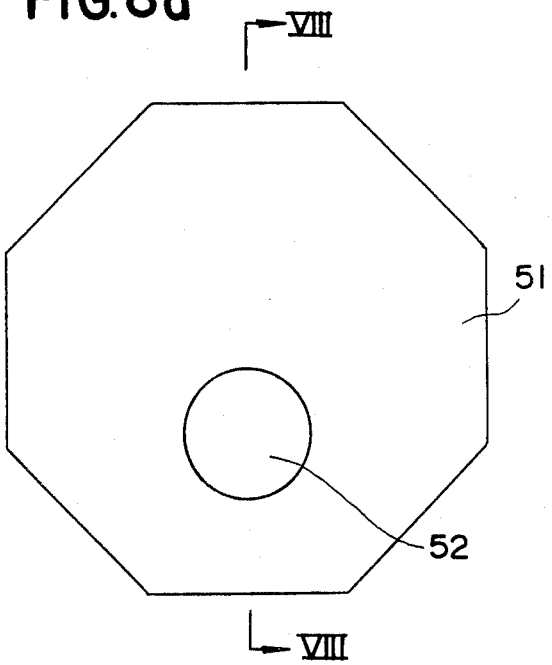
FIG. 8*a* and 8*b* are respectively a plan view showing an example of the slide plate brick used in the rotary nozzle system according to the invention and a sectional view taken along the line VIII—VIII of FIG. 8*a*.
Figure 8B:
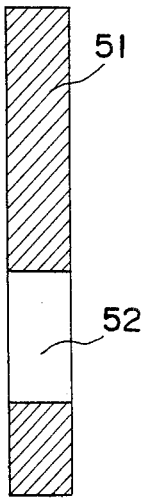

Since the slide plate brick 17 is pressed against the bottom plate brick 7 by the springs 29, when the rotor 12 is rotated, the rotation is transmitted to the flat portion 20 of the slide plate brick 17 from the locking portion 15 of the rotor 12 and the slide plate brick 17 is driven into rotation by the locking portion 15. However, the relation between the locking portion 15 and the flat portion 20 is such that the rotational and linear binding is provided only in one direction. Thus, when the rotor 12 is rotated, there is the danger of the slide plate brick 17 escaping in a direction parallel to the flat portion 20 and this causes an excessive sliding movement, thereby promoting the entry of the slag or molten steel between the sliding surfaces. Referring now to FIGS. 7 and 8, there is illustrated an embodiment of the invention with FIG. 7*a* showing a plan view of its fixed bottom plate brick, FIG. 7*b* a sectional view taken along the line VII—VII of FIG. 7*a*, FIG. 8*a* a plan view of its slide plate brick and FIG. 8*b* a sectional view taken along the line VIII—VIII of FIG. 8*a*.

Figure 9:
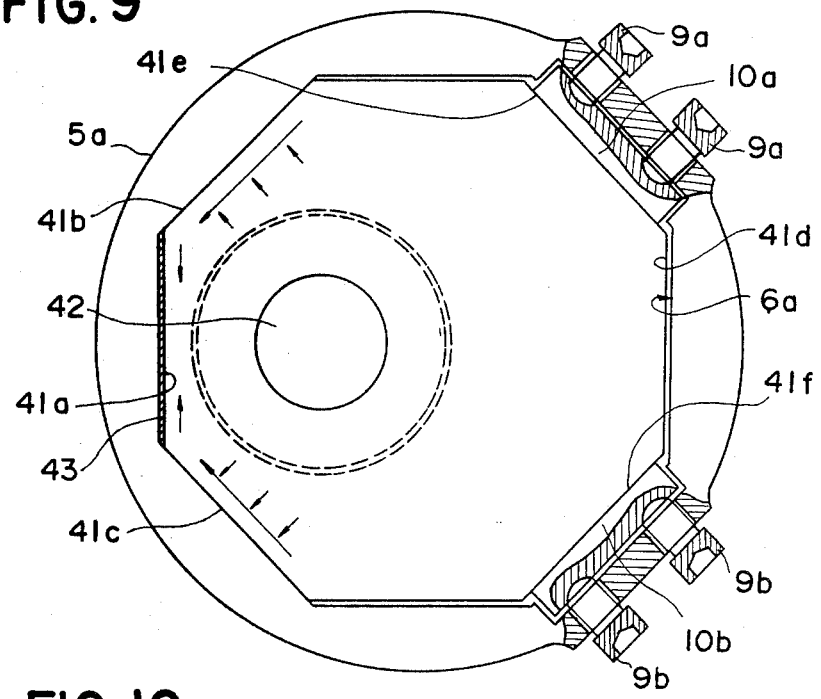
FIG. 9 is a plan view showing the condition in which a fixed bottom plate brick is received in a support frame in a rotary nozzle system according to an embodiment of the invention.

In the rotary nozzle system according to this embodiment, each of a fixed bottom plate brick 41 and a slide plate brick 51 has a regular octagonal planar outer shape and includes a nozzle bore 42 or 52 formed so as to position its center on the vertical bisector of one side of the octagon. While, in this embodiment, the slide plate brick 51 includes the single nozzle bore 52, it is possible to form two or more nozzle bores. The illustrated plate bricks 41 and 51 have the regular octagonal planar outer shapes of the same size so that the nozzle bores 42 and 52 are aligned exactly when the plate bricks 41 and 51 are placed one upon another so as to bring their outer shapes into registration. FIG. 9 is a bottom view of the rotary nozzle system showing the condition in which the bottom plate brick 41 is mounted in a support frame 5*a* and the support frame 5*a* is formed with a recess 6*a* of the octagonal shape which is similar in shape, slightly greater in size and slightly smaller in depth than the thickness of the bottom plate brick 41. The bottom plate brick 41 is received in the recess 6*a* and it is pressed and held in place by screws 9*a* and 9*b* through locking pieces 10*a* and 10*b* respectively arranged at wall surfaces 41*e* and 41*f* on one side thereof.

Figure 10:
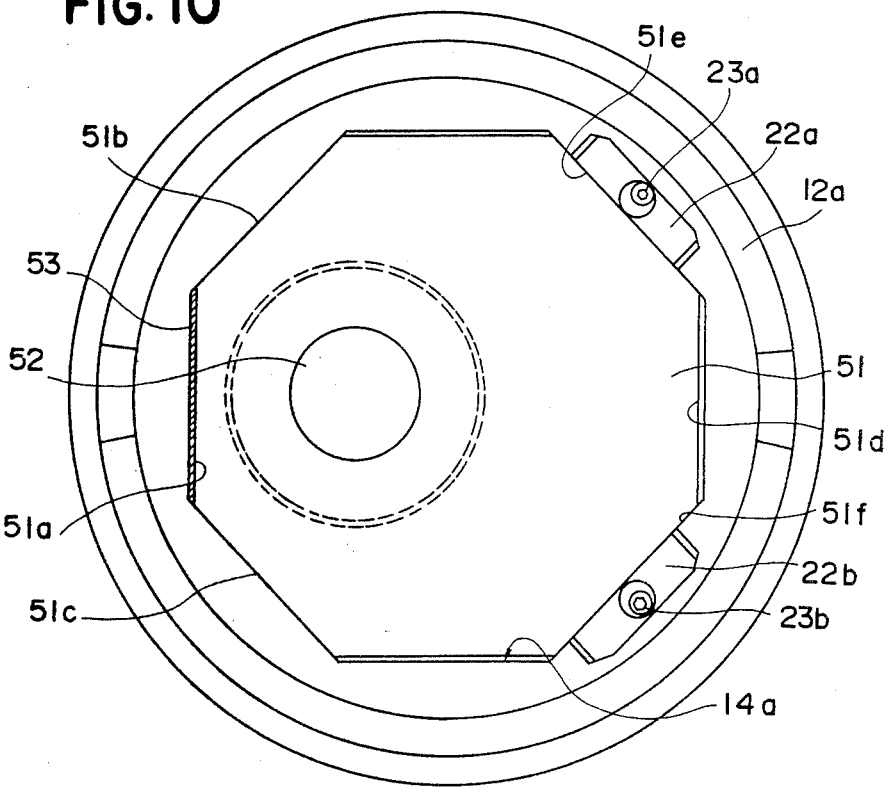
FIG. 10 is a plan view showing the condition in which a slide plate brick is received in a frame support (rotor) in the rotary nozzle system according to the embodiment of the invention.

FIG. 10 is a plan view of the rotary nozzle system showing the condition in which the slide plate brick 51 is mounted on a rotor 12*a* and the rotor 12*a* is formed with an octagonal recess 14*a* which is similar in shape, slightly greater in size and slightly smaller in depth than the thickness of the slide plate brick 51. The slide plate brick 51 is received in the recess 14*a* and it is pressed and held in place by wedges 22*a* and 22*b* and screws 23*a* and 23*b* through wall surfaces 51*e* and 51*f* on one side thereof. In FIGS. 9 and 10, numerals 43 and 53 designate heat-resisting cushioning members which are each provided between the inner wall surface opposite to the pressing side of the recess 6*a* or 14*a* and a wall surface 41*a* or 51*a* of the bottom plate brick 41 or the slide plate brick 51 and these cushioning members need not necessarily be provided. Also, while the plate bricks 41 and 51 are each held in place with the screws 9*a* and 9*b* or the wedges 22*a* and 22*b*, any other means may be used.

As will be seen from the figures, the bottom plate brick 41 and the slide plate brick 51 respectively received in the recesses 6*a* and 14*a* of the support frame 5 and the rotor 12 are positively held in place in the recesses 6*a* and 14*a* by virtue of the fact that the wall surfaces 41*b*, 41*c* and 51*b*, 51*c* opposing the pressing sides on the opposite side thereto are pressed against the inner wall surfaces of the recesses 6*a* and 14*a*, respectively. Thus, each of the bottom plate brick 41 and the slide plate brick 51 has its outer periphery bound from all the sides at intervals of 90° and this is much effective in precenting the spreading of the cracks in the bottom plate brick 41 and the slide plate brick 51, thereby eliminating the need to wrap a steel band. Also, each of the plate bricks 41 and 51 is bound at the regular four sides so that even if the wedges 22*a* and 22*b* or the screws 23*a* and 23*b* are loosened, the slide plate brick 51 has an automatic centripetal function and therefore there is no danger of the slide plate brick shifting in a straight direction as in the case of the conventional system.

Figure 11:
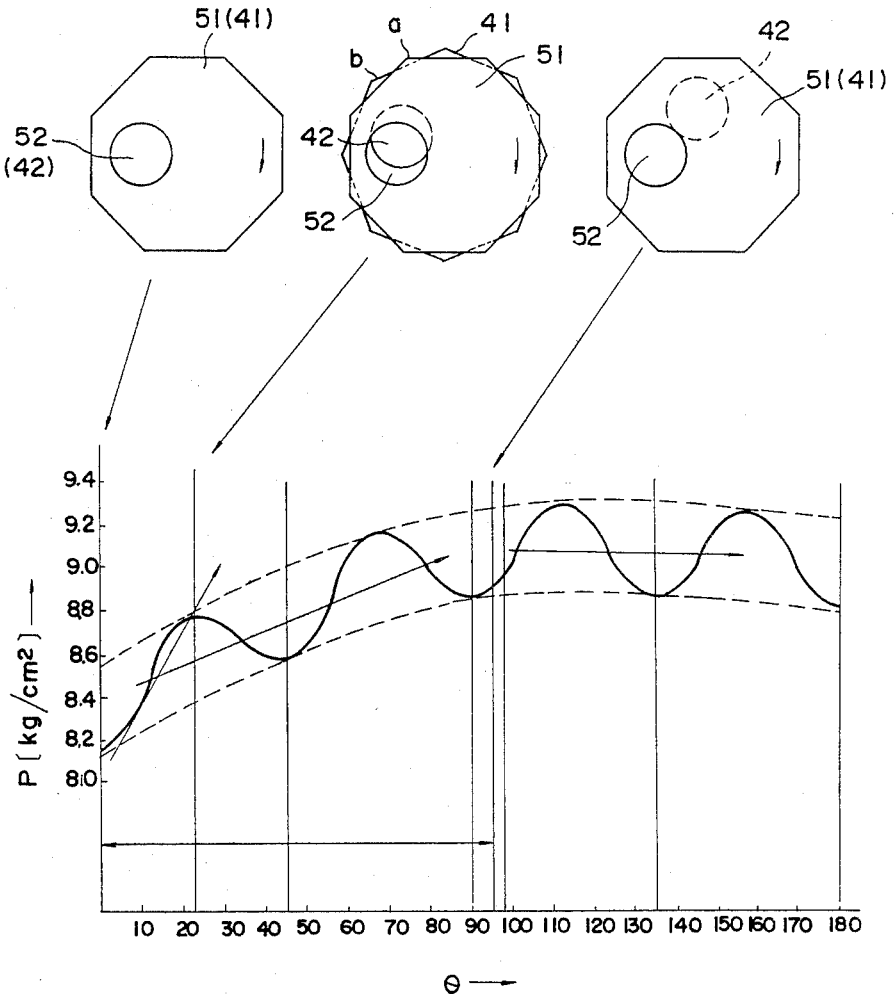
FIG. 11 is a graph showing the relation between the relative rotational angle $\theta$ (abscissa) and the interfacial pressure P (ordinate) between the sliding surfaces in the rotary nozzle system according to the embodiment of the invention.

FIG. 11 is a graph useful for explaining the operation of the embodiment. With this embodiment, the interfacial pressure is as low as about 8.15 $Kg/cm^2$ when the nozzle bores 42 and 52 of the bottom plate brick 41 and the slide plate brick 52 are fully opened (at this time the rotational angle $\theta$ of the slide plate brick 51 is assumed 0°). Then, when the slide plate brick 51 is rotated in the direction of an arrow so that the nozzle bores 42 and 52 start to close, in response to the movement of the nozzle bore 52 of the slide plate brick 51 the contact area S between the plate bricks 41 and 51 is decreased and noncontact portions a and b are formed at the peripheral edges of the plate bricks 41 and 51. The area of these noncontact portions a and b becomes maximum when the slide plate brick 51 has rotated 22.5°. When this occurs, the contact area S is decreased rapidly and the interfacial pressure P is increased up to about 8.75 $Kg/cm^2$. In other words, during the interval the interfacial pressure P is increased by about 0.6 $Kg/cm^2$ (about 7.4%). In this connection, the conventional system of FIG. 5 showed an increase of about 0.2 $Kg/cm^2$ (about 2.3%) during the interval.

Then, when the slide plate brick 51 is rotated further through 45°, while the noncontact area due to the movement of the nozzle bore 52 is increased, the peripheral edge noncontact portions a and b are reduced to zero so that the contact area S on the whole is increased and the interfacial pressure P is decreased. Then, as the slide plate brick 51 is rotated further, the area of the noncontact portion and the peripheral edge noncontact portions a and b due to the nozzle bore 52 is increased and the interfacial pressure P is increased again. In this way, the interfacial pressure P varies to describe a sine curve and it shows a tendency to increase with a steeper curve than the conventional system.

Thus, in accordance with the invention, the interfacial pressure P is increased rapidly by the variation in the contact area S of the plate bricks 41 and 51 during the initial period of the closing of the nozzle bores 42 and 52 and this deals with the impact force of the molten steel applied to the edges of the nozzle bores 41 and 51 and the introduction of the molten steel thereto, thereby preventing the molten steel from entering between the sliding surfaces of the plate bricks 41 and 51.

The inventor of the invention, etc., have conducted various experiments on plate bricks of the regular decagonal, hexagonal and other shapes in the course of completion of the invention and it has been found that the regular decagonal bricks are nearly circular thus failing to ensure a rapid rise of the interfacial pressure, that the regular hexagonal brick includes sharp angled portions so that even very small deformations of the plate bricks give rise to the danger of the edges of the sliding surfaces interferring with each other and making the relative rotation impossible and that the regular octagonal bricks are excellent in all respects.

While, in the above-described embodiment, the invention is applied to a rotary nozzle system of the type in which its support frame and rotor are opened and closed in a door-like manner, the invention is not limited thereto and it may, for example, be applied to rotary nozzle systems of different constructions including one in which a fixed plate brick is directly attached to a base member and a slide plate brick is mounted on a rotor which is opened and closed like a door and another in which a slide plate brick is mounted on a vertically detachable rotor. Also, while, in this embodiment, each of the bottom plate brick and the slide plate brick is secured at two locations to the support frame or the rotor, each of the plate bricks may be secured at a single location.

Then, if the brick changing operation in a rotary nozzle system of the above type is effected by the operators wearing dirty globes, there sometime is the danger of mortar sticking to the sliding surfaces of the plate bricks so that if the door is closed thus setting the bricks as such in place, the surface-to-surface contact between the sliding surfaces is affected seriously and the molten metal is caused to penetrate during the sliding movement, thereby sometimes causing leakage of the molten metal.

Also, the solid matters such as the tar and lubricant may cause the similar effect as mentioned above.

In accordance with a second embodiment of the invention which will now be described, there is provided a rotary nozzle system in which the sliding surface of a bottom plate brick is formed with at least one groove extending from the inside to the outer periphery thereof so that in response to the rotation of a slide plate brick a large part of the extraneous matter existing between the plate bricks is discharged and an excellent contact is ensured between the sliding surfaces.

When the slide plate brick is rotated, the extraneous matter existing between the plate bricks is discharged to the outside through the noncontacting portions and the nozzle bores and the extraneous matter existing between the nozzle bores and the outer peripheries is stored in the groove, thereby ensuring an excellent contact between the sliding surfaces.

Figure 12:
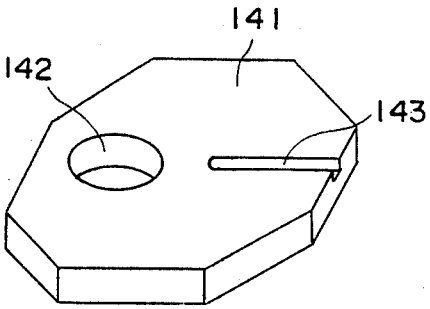
FIG. 12 is a perspective view showing the fixed bottom plate brick used in a rotary nozzle system according to another embodiment of the invention.

FIG. 12 is a perspective view of the fixed bottom plate brick used in the rotary nozzle system according to the second embodiment of the invention. In this embodiment, a groove 143 is formed in the sliding surface of a fixed bottom plate brick 141 at a position opposite to a nozzle bore 142 to extend from the inside to the outer periphery thereof.

Figure 13:
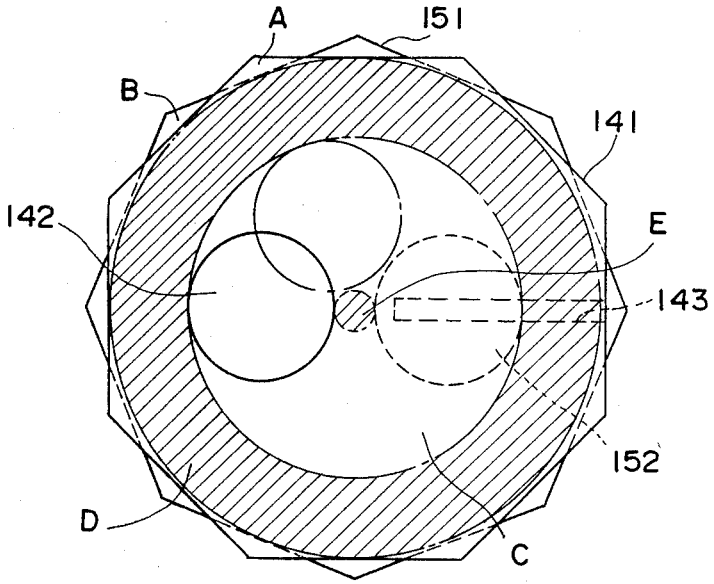
FIG. 13 is a schematic diagram showing the relative rotational angular positional relation between the fixed bottom plate brick of FIG. 12 and the slide plate brick in surface-to-surface contact with the former.

With the second embodiment constructed as described above, when a slide plate brick 151 is rotated as shown in FIG. 13, the extraneous matter existing between the plate bricks 141 and 151 is discharged in such a manner that it is discharged to the outside through noncontacting surface portions A and B in the outermost peripheral portions and through the nozzle bore 142 in a zone C and it is stored in the groove 143 in a zone D, thereby greatly improving the contact between the sliding surfaces of the plate bricks 141 and 151.

It is to be noted that the extraneous matter existing in the central portion or a zone E is small and its effect on the contact between the sliding surfaces is not large, thus making it unnecessary to give any particular consideration to the discharging of the extraneous matter in the zone E. Also, it is required that the length of the groove 143 be at least the same or slightly greater than the width of the zone D. Alternatively, the groove 143 may be extended to near to the center of the plate brick 141 as in the case shown in FIG. 13. However, if the groove 13 is extended to be so close to the nozzle bore 142, there is the danger of the groove 143 communicating with the nozzle bore 142 in the event of melting loss of the latter and thereby causing leakage of the molten metal. Thus, there should preferably be some distance between the groove 143 and the nozzle bore 142.

Figure 14:
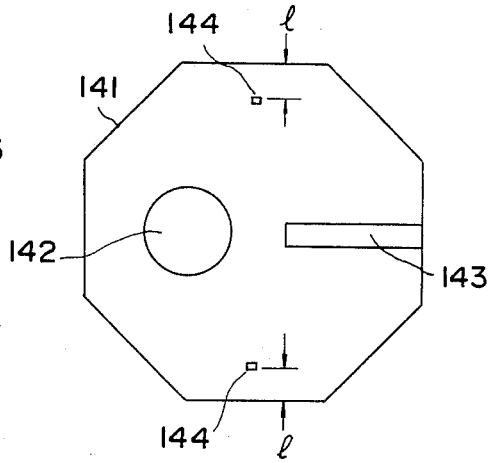
FIG. 14 is a plan view of the fixed bottom plate brick shown in FIG. 12.
Figure 15:
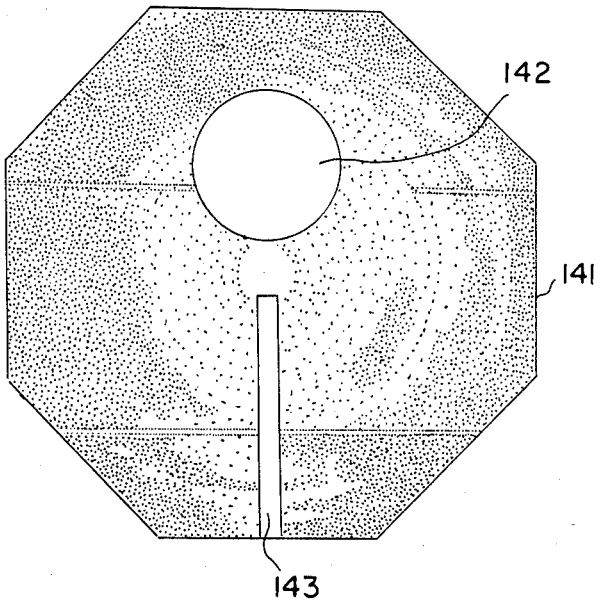
FIG. 15 shows the measurement result of the surface-to-surface contact condition obtained by using the fixed bottom plate brick of FIG. 12.
Figure 16:
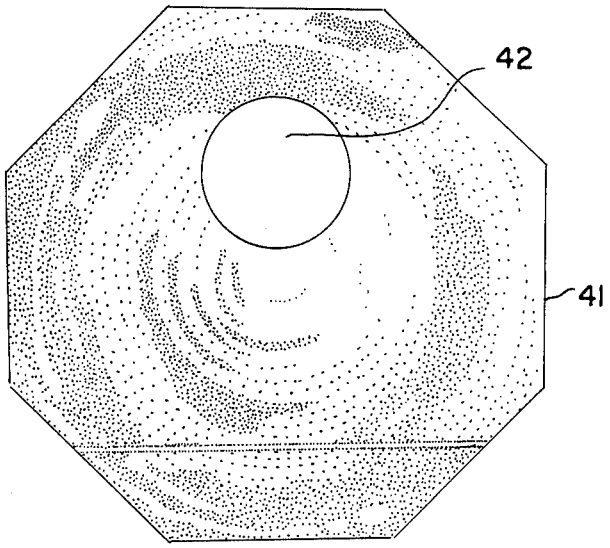
FIG. 16 shows the measurement result of the surface-to-surface contact condition obtained by using the fixed bottom plate brick with no grove shown in FIG. 7*a*.

FIGS. 15 and 16 show the results of the experiments conducted by using the bottom plate brick 141 of this embodiment and the bottom plate brick 41 of FIG. 7*a* which has no groove 143 in the sliding surface and rotating the slide plate brick with the extraneous matters of the same size attached between the bottom plate brick and the slide plate brick in each case. Each of the bottom plate bricks 141 and 41 had an inscribed circle of 320 mm and a thickness of 45 mm, and a groove 143 having a width of 15 mm, a depth of 5 mm and a length 145 mm was formed in the sliding surface of the bottom plate brick 141 on the opposite side to a nozzle bore 142. Also, the extraneous matters were solid mortar of 10 $mm^3$ and two extraneous matters 144 were symmetrically arranged at positions apart by a distance l (25 mm) from the outer side on either side as shown in FIG. 14 and the slide plate brick was rotated to make two rotations from the fully-open nozzle bore position at the room temperature. Then, a pressure sensitive paper was inserted between the fixed plate brick and the slide plate brick to determine the contact condition between the plate bricks.

In accordance with the results of the experiments, it was confirmed that while, in the rotary nozzle system using the bottom plate brick 141 according to the second embodiment, the contact (the block portion in the Figures) of the sliding surfaces is improved considerably and satisfactory on the whole as shown in FIG. 15, in the case employing the bottom plate brick 41 having no groove in its sliding surface the block portion is reduced and the contact of the sliding surfaces is deteriorated greatly as shown in FIG. 16. In the Figures, the horizontal white straight lines in the lower parts show the joints of the heat sensitive papers.

While, in the above-described embodiment, the groove 143 is provided at a position which opposite to and symmetrical with the nozzle bore 142, the groove 143 may be provided at any other position provided that the nozzle bores 142 and 152 and the groove 143 do not communicate simultaneously during the rotation of the slide plate brick 141 and also its number is not limited to one, that is, two or more grooves may be provided. The shape of the groove 143 needs not be of the same width over its whole length and it may for example be shaped to increase gradually in width toward its outer end or to have a triangular shape in section.

I claim:

1. In a rotary nozzle system of the type in which a slide plate brick and bottom plate brick, each thereof having at least one nozzle bore, are relatively rotated in a surface-to-surface contact condition to adjust a degree of communication opening of said nozzle bores to control a rate of pouring of molten metal, each of said plate bricks being formed on an outer peripheral surface thereof with a flat portion at each of four locations arranged at angular intervals of 90° for receiving a driving force for said relative rotation and a reaction force.

2. A rotary nozzle system according to claim 1, wherein each of said plate bricks has a regular octagonal outer shape.

3. A rotary nozzle system according to claim 1, wherein the outer periphery of each of said plate bricks is enclosed by a support frame having four flat inner peripheral wall surfaces arranged at angular intervals of 90° F. in correspondence to said flat portions, and wherein two of said flat inner peripheral wall surfaces, which are not opposing each other, are each adjustable in position so as to be close to and away from corresponding one of said flat portions.

4. A rotary nozzle system according to claim 1, wherein said slide plate brick and said bottom plate brick have regular octagonal outer shapes of the same size with each other, whereby said regular octagonal outer shapes of said plate bricks are registered exactly when said nozzle bores of said plate bricks are in alignment.

5. A rotary nozzle system according to claim 1, wherein at least one groove is formed in a sliding surface of said bottom plate brick to extend from the inside to the outer periphery thereof.

6. A rotary nozzle system according to claim 5, wherein said groove is formed at a position whereby said groove is not simultaneously communicated with said nozzle bores within a range of angles of said relative rotation.

7. A rotary nozzle system according to claim 5, wherein said groove extends radially with respect to the center of said relative rotation of said slide plate brick on the opposite side to said nozzle bore thereof.

8. In a rotary nozzle system of the type in which a slide plate brick and bottom plate brick, each thereof having at least one nozzle bore, are relatively rotated in a surface-to-surface contact condition to adjust a degree of communication opening of said nozzle bores to control a rate of pouring of molten metal, each of said plate bricks being formed on an outer peripheral surface thereof with a flat portion at each of four locations arranged at angular intervals of 90° for receiving a driving force for said relative rotation.

9. In a rotary nozzle system of the type in which a slide plate brick and bottom plate brick, each thereof having at least one nozzle bore, are relatively rotated in a surface-to-surface contact condition to adjust a degree of communication opening of said nozzle bores to control a rate of pouring of molten metal, each of said plate bricks being formed on an outer peripheral surface thereof with a flat portion at each of four locations arranged at angular intervals of 90° for receiving a reaction force.

* * * * *

UNITED STATES PATENT AND TRADEMARK OFFICE

CERTIFICATE OF CORRECTION

PATENT NO. : 4,732,304

DATED : March 22, 1988

INVENTOR(S) : Tetsuya YOSHIHARA

It is certified that error appears in the above-identified patent and that said Letters Patent is hereby corrected as shown below:

IN THE CLAIMS:

Column 9, Claim 3, Line 28, after "90°" please delete "F".

Signed and Sealed this

Twenty-second Day of November, 1988

*Attest:*

DONALD J. QUIGG

*Attesting Officer*

*Commissioner of Patents and Trademarks*